US010103484B2

(12) United States Patent
Shimizu et al.

(10) Patent No.: US 10,103,484 B2
(45) Date of Patent: Oct. 16, 2018

(54) LEVER-TYPE CONNECTOR

(71) Applicant: YAZAKI CORPORATION, Tokyo (JP)

(72) Inventors: Tomohiko Shimizu, Makinohara (JP); Shogo Suzuki, Makinohara (JP); Hidenori Kanda, Makinohara (JP); Masayuki Saito, Makinohara (JP); Takuya Hasegawa, Fujieda (JP); Kazuya Terao, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/696,406

(22) Filed: Sep. 6, 2017

(65) Prior Publication Data

US 2018/0069345 A1 Mar. 8, 2018

(30) Foreign Application Priority Data

Sep. 7, 2016 (JP) ..... 2016-174970

(51) Int. Cl.
*H01R 13/629* (2006.01)

(52) U.S. Cl.
CPC ..... *H01R 13/62938* (2013.01)

(58) Field of Classification Search
CPC ..... H01R 13/62938
USPC ..... 439/157
See application file for complete search history.

(56) References Cited

U.S. PATENT DOCUMENTS 5,611,703 A * 3/1997 Okamoto et al. ..... H01R 13/62
8,215,979 B2 * 7/2012 Shamoto ..... H01R 13/62938 439/372
8,251,761 B2 * 8/2012 Shamoto ..... H01R 13/62938 439/892
8,573,991 B2 * 11/2013 Kamiya ..... H01R 13/62961 439/157
8,641,433 B2 * 2/2014 Uchida ..... H01R 13/62955 439/157
8,986,024 B2 * 3/2015 Ikeda ..... H01H 9/102 200/332
2012/0318645 A1 * 12/2012 Kobayashi ..... H01H 9/0066 200/50.01
2013/0252446 A1 * 9/2013 Forell ..... H01R 13/62938 439/157

(Continued)

FOREIGN PATENT DOCUMENTS

JP 2013-026154 A 2/2013

*Primary Examiner* — Harshad C Patel
(74) *Attorney, Agent, or Firm* — Sughrue Mion, PLLC

(57) ABSTRACT

A lever-type connector includes a housing configured to be inserted into a mating housing of a mating connector, and a lever that is pivotally operable between a temporary locking position and a fitting completion position. The lever includes a pair of side plates and an operating portion. The housing has a lever-protection wall, protruding outward beyond a pivotal outer peripheral end of the lever disposed at the temporary locking position, the lever-protection wall being provided at an end portion of the housing in a direction opposite to a rotational direction in which the lever rotates from the temporary locking position toward the fitting completion position. The lever disposed at the temporary locking position is arranged so that the operating portion of the lever overlaps the lever-protection wall.

3 Claims, 8 Drawing Sheets

(56) References Cited

U.S. PATENT DOCUMENTS

2014/0178121 A1 6/2014 Kamiya

* cited by examiner

LEVER-TYPE CONNECTOR

CROSS REFERENCE TO RELATED APPLICATIONS

This application is based on Japanese Patent Application (No. 2016-174970) filed on Sep. 7, 2016, the contents of which are incorporated herein by reference.

BACKGROUND OF THE INVENTION

1. Field of the Invention

The present invention relates to a lever-type connector.

2. Description of the Related Art

Conventionally, a lever-type connector is known that can perform a connector fitting with a low insertion force due to a rotational force by rotating a lever pivotally mounted on a housing so that the connector is fitted to a mating housing of a mating connector (see, for example, JP-A-2013-26154).

In this lever-type connector, the housing is fitted into the mating housing in a state where the lever is located in the temporary locking position, which is the initial position, and thereafter the lever is pivoted to the fitting completion position, and by engaging and locking to the lock portion of the housing, the housing remains in a state of being fitted to the mating housing.

The lever may be unintentionally rotated to a position deviating from the initial position during packing or transportation before fitting to the mating connector. In such a case, the lever must be returned to the initial position and then fitted to the mating connector, which complicates the fitting operation.

SUMMARY OF THE INVENTION

The present invention has been made in view of the above circumstances, and an objective of the present invention is to provide a lever-type connector capable of smoothly performing a fitting operation with a mating connector.

To achieve the above objective, a lever-type connector according to the present invention is characterized by (1) and (2) below.

(1) A lever-type connector includes:

a housing configured to be inserted and removed from a mating housing of a mating connector;

a lever, pivotally mounted on the housing, and that is pivotally operable between a temporary locking position and a fitting completion position of the lever, the lever comprising:

a pair of side plates arranged along surfaces on both sides of the housing; and an operating portion that connects ends of the side plates, wherein the housing is configured to be fitted to the mating housing by rotating the lever from a fitting start position to the fitting completion position; and wherein the housing has a lever-protection wall, protruding outward beyond a pivotal outer peripheral end of the lever disposed at the temporary locking position, the lever-protection wall being provided at an end portion of the housing in a direction opposite to a rotational direction in which the lever rotates from the temporary locking position toward the fitting completion position; and wherein the lever disposed at the temporary locking position is arranged so that the operating portion of the lever overlaps the lever-protection wall.

(2) The lever-type connector according to (1), wherein cam grooves are provided in the side plates of the lever respectively and are configured to pull cam bosses formed on both outer surfaces of the mating housing thereinto in accordance with a rotation of the lever from the temporary locking position to the fitting completion position; and when the mating housing and the housing are fitted together, the cam bosses are pushed into the cam grooves respectively, and the lever is rotated toward the fitting start position in a state that the cam bosses are entered into the cam grooves respectively.

In the lever-type connector of the configuration in (1), the lever-protection wall formed on the housing protrudes outward beyond the rotating outer peripheral end of the lever that is disposed at the temporary locking position, and moreover, the operating portion of the lever disposed at the temporary locking position is disposed so as to overlap the lever-protection wall. Therefore, the lever is prevented from being unintentionally rotated to a position deviating from the initial position during packing or transportation before fitting to the mating connector. Accordingly, it is possible to eliminate the troublesome work of returning the unintentionally rotated lever to the temporary locking position, which is the initial position when fitting the lever to the mating connector, and thereby smoothly perform the fitting operation with the mating connector.

In the lever-type connector having the configuration in (2), when the mating housing and the housing are fitted together, the cam bosses are pushed into the cam grooves and the lever in the temporary locking position moves toward the fitting start position so that the operating portion of the lever, disposed so as to overlap with the lever-protection wall, separates from the lever-protection wall. From this, the operator can easily hold the operating portion of the lever and smoothly rotate the lever to the fitting completion position, thereby, making it easy to perform the fitting operation to the mating connector.

According to the present invention, it is possible to provide a lever-type connector capable of smoothly performing a fitting operation with a mating connector.

The present invention has been briefly described above. Furthermore, details of the present invention will be further clarified by reading about the forms for carrying out the invention (hereinafter referred to as "embodiments") described below with reference to the attached drawings.

BRIEF DESCRIPTION OF THE DRAWINGS

FIGS. 6A and 6B are explanation views that describe the movement of the locking protrusion and the cam boss by rotation of the lever, wherein FIG. 6A shows a state before the housing is fitted to the mating connector, and FIG. 6B shows a state in which the housing is fitted in the mating connector and the cam boss is in contact with the cam groove.

FIGS. 7A and 7B are explanation views that describe the movement of the locking protrusion and the cam boss by rotation of the lever, wherein FIG. 7A shows a state in which the housing is pushed into the mating connector and the lever is moved from the temporary locking position to the fitting start position, and FIG. 7B shows a state in which the lever has been moved to the fitting completion position.

DETAILED DESCRIPTION OF THE EXEMPLARY EMBODIMENTS

Hereinafter, an embodiment of the present invention will be described with reference to the drawings.

Figure 1:
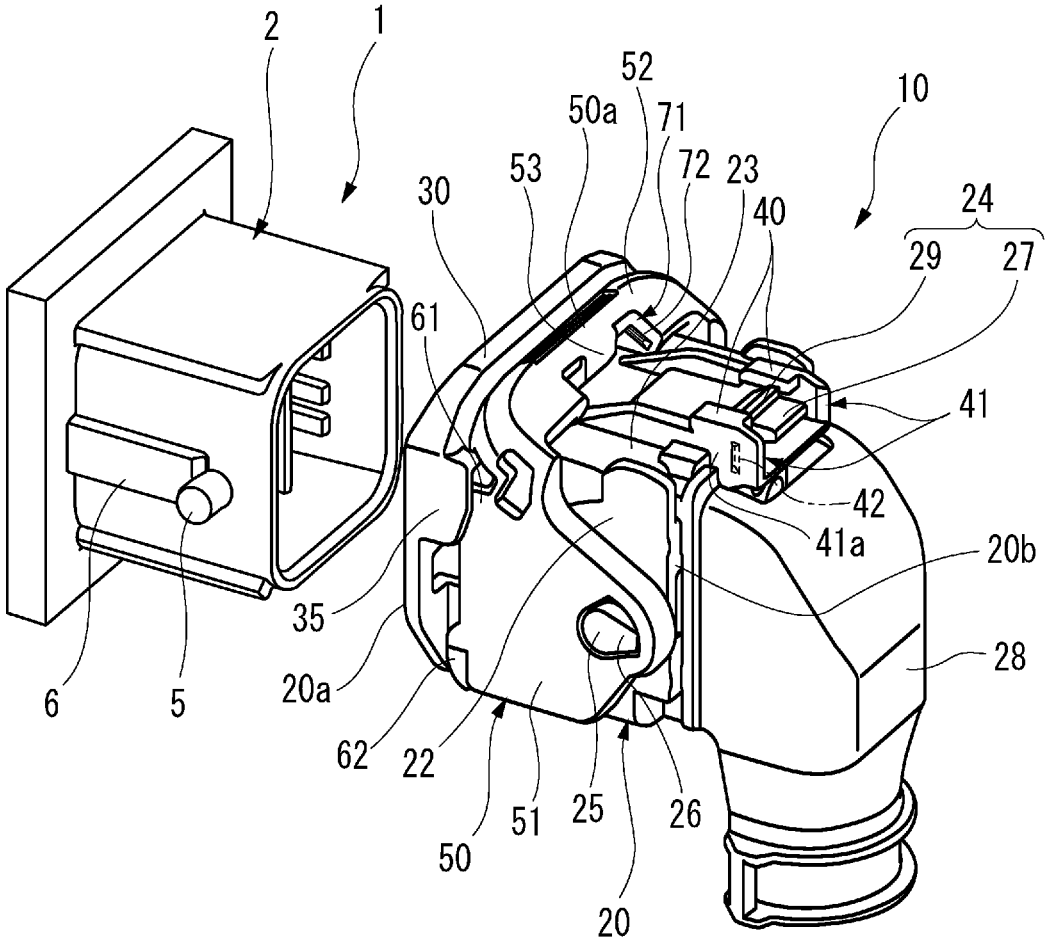
FIG. 1 is a perspective view of a lever-type connector according to an embodiment of the present invention viewed from a rear before being fitted to a mating connector.
Figure 2:
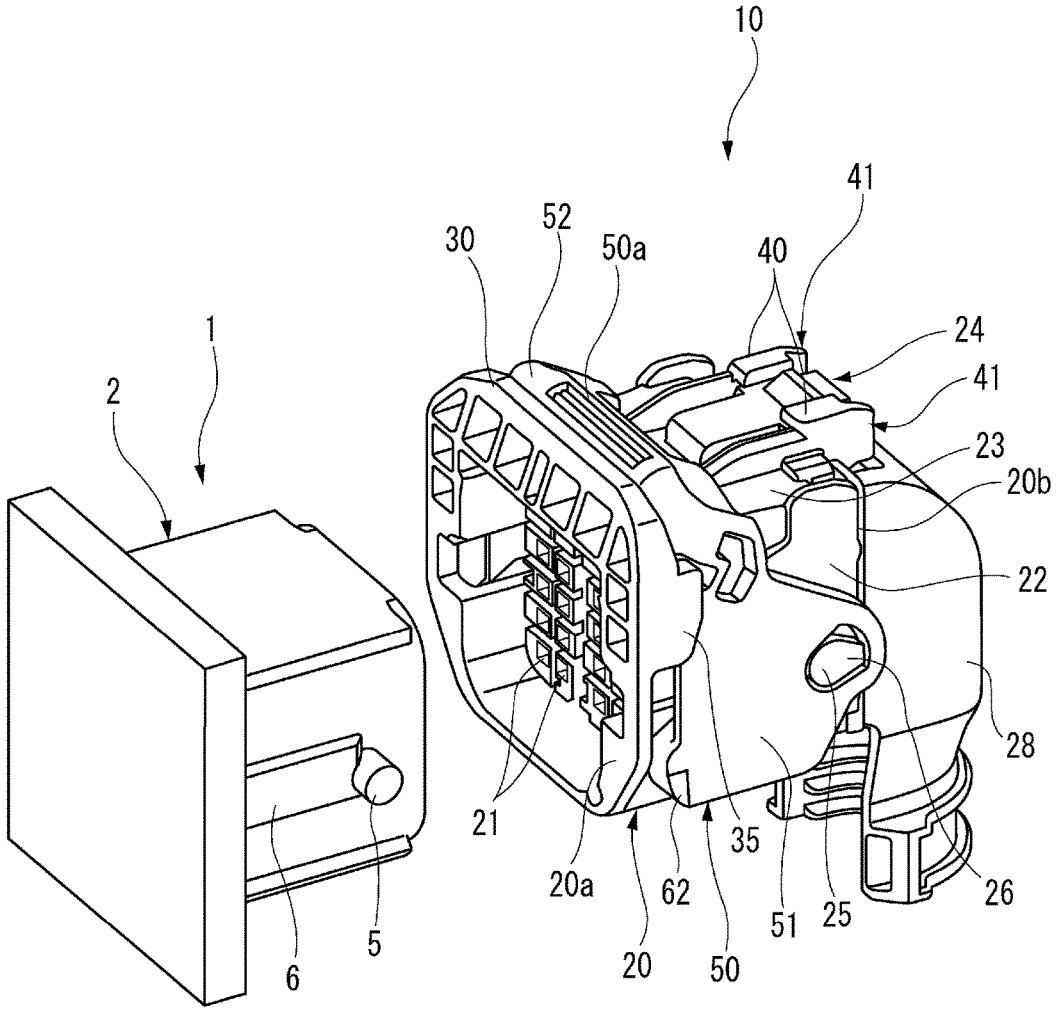
FIG. 2 is a perspective view of the lever-type connector shown in FIG. 1 as viewed from a front.
Figure 3A:
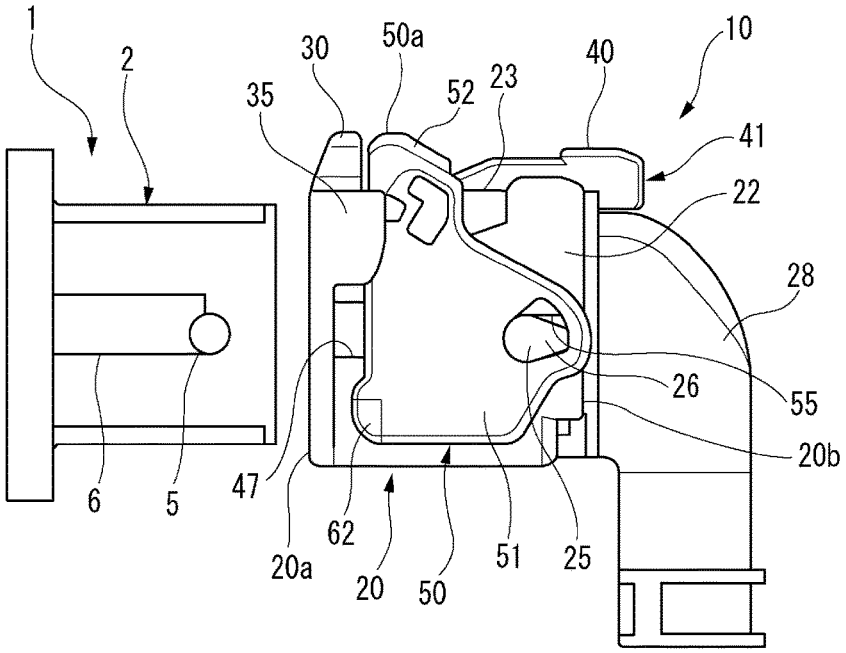
FIG. 3A is a side view of the lever-type connector in a state where the lever is disposed at the temporary locking position.
Figure 3B:
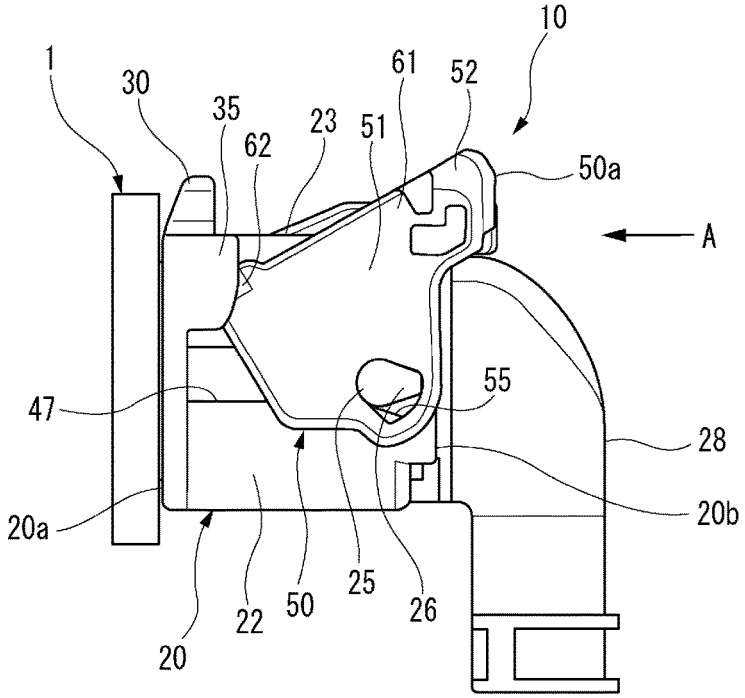
FIG. 3B is a side view of the lever-type connector in a state where the lever is disposed at the fitting completion position.

FIG. 1 is a perspective view of a lever-type connector 10 according to an embodiment of the present invention viewed from the rear before being fitted to a mating connector 1. FIG. 2 is a perspective view of the lever-type connector 10 shown in FIG. 1 as viewed from the front. FIG. 3A is a side view of the lever-type connector 10 in a state where the lever 50 is disposed at the temporary locking position; FIG. 3B is a side view of the lever-type connector 10 in a state where the lever 50 is disposed at the fitting completion position.

As shown in FIGS. 1 to 3B, the lever-type connector 10 according to the present embodiment includes a housing 20 and a lever 50. The lever-type connector 10 is fitted to the mating connector 1 by fitting the mating housing 2 and the housing 20 to each other. The lever 50 has a pair of side plates 51 arranged along the surface on both sides 22 of the housing 20 and an operating portion 52 connecting the ends of the side plates 51. The lever 50 is rotatable around an axis in the horizontal direction with respect to the housing 20.

The lever 50 is rotated between a temporary locking position (see FIG. 3A) and a fitting completion position (see FIG. 3B). The housing 20 has a lock portion 24 for locking the operating portion 52 of the lever 50 on the upper surface 23 of the housing 20. The lever 50 locks into the fitting completion position by the lock portion 24 when the operating portion 52 is engaged and locked to the lock portion 24. The lever-type connector 10 is assisted in fitting to and detaching from the mating connector 1 by rotation of the lever 50. That is, the lever-type connector 10 is an LIF (Low Insertion Force) connector that is fitted to the mating connector 1 with a low insertion force by operation of the lever 50.

The housing 20 is made of insulating synthetic resin, and a front part 20*a* of the housing 20 is fitted to the mating housing 2 of the mating connector 1. The housing 20 has a plurality of terminal accommodating chambers 21. These terminal accommodating chambers 21 are formed along a direction of fitting with the mating connector 1, and terminals (not shown) connected to electrical wires (not shown) are accommodated in the respective terminal accommodating chambers 21. Electrical wires connected to terminals accommodated in the terminal accommodating chambers 21 are pulled out from a rear part 20*b* of the housing 20. An electrical wire cover 28 is attached to the rear part 20*b* of the housing 20, and the electrical wires pulled out from the rear part 20*b* of the housing 20 are covered with the electrical wire cover 28 and is bundled and pulled out in one direction (downward in this example). By fitting the lever-type connector 10 into mating connector 1, terminals accommodated in the terminal accommodating chambers 21 of the housing 20 are electrically connected to the terminals provided in the mating housing 2 of the mating connector 1.

In addition, the housing 20 has a lever-protection wall 30. The lever-protection wall 30 is formed on the front portion 20*a* of the housing 20 which is provided in the opposite side to the rotational direction in which the lever 50 rotates toward the fitting completion position. The lever-protection wall 30 protrudes outward beyond the rotating outer peripheral end 50*a* of the lever 50 in the temporary locking position. The lever 50 disposed at the temporary locking position is arranged so that the lever 50 overlaps the lever-protection wall 30. Furthermore, the lever-protection wall 30 may have the same overhang height as the rotating outer peripheral end 50*a* of the lever 50 in the temporary locking position.

Figure 4A:
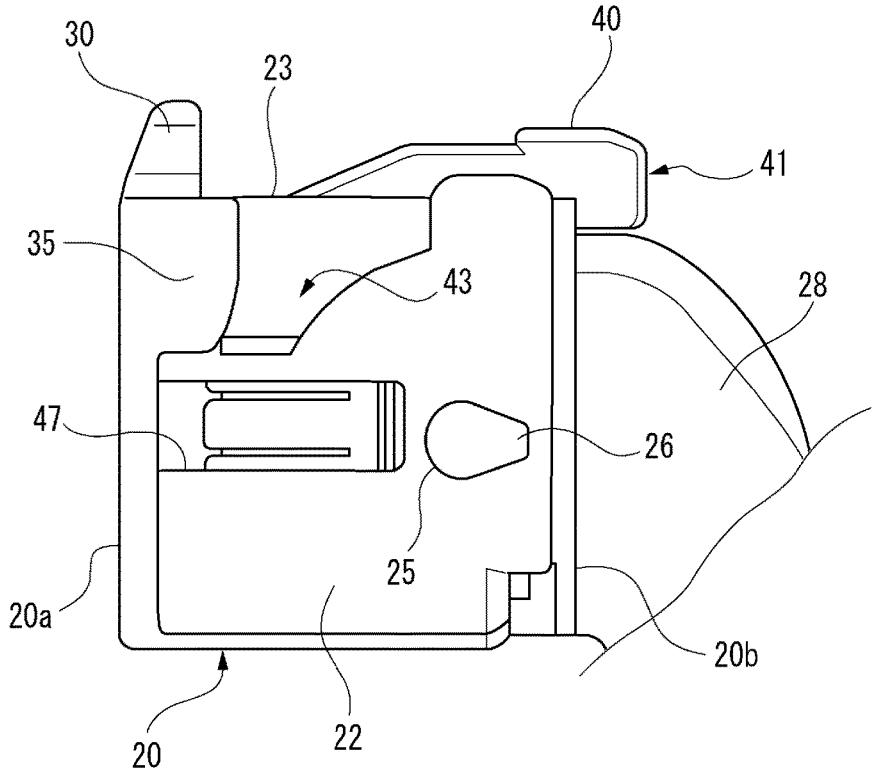
FIG. 4A is a side view of the housing shown in FIG. 1.
Figure 4B:
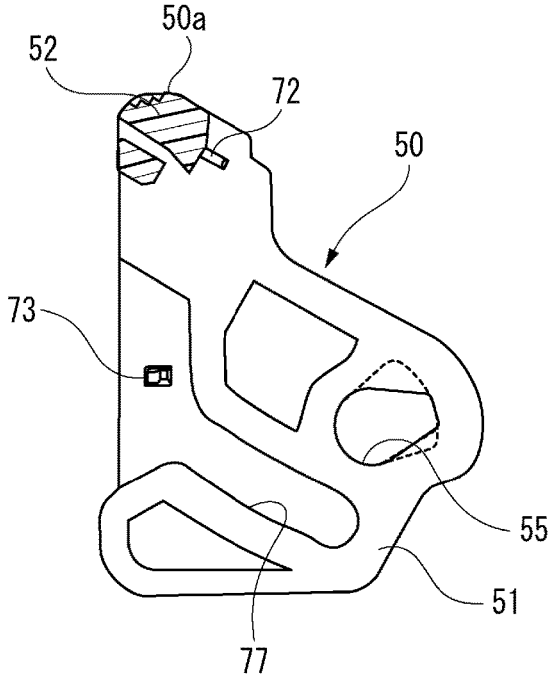
FIG. 4B is a cross sectional view showing the inner surface of the side plate of the lever shown in FIG. 1.

As shown in FIG. 4A, support shafts 25 protrude on both sides 22 of the housing 20. As shown in FIG. 4B, the lever 50 has a pivot hole 55 in each of the side plates 51, and the support shafts 25 of the housing 20 are respectively inserted in the pivot holes 55. As a result, the lever 50 is rotatable about the support shaft 25 inserted through the pivot holes 55 of the side plates 51. A locking piece 26 that extends rearward of the housing 20 with intersecting the support shaft axis is formed at the tip of each of the support shafts 25.

In each of the side plates 51, the pivot hole 55 has a shape corresponding to the outer shape of the locking piece 26, the locking piece 26 can only be inserted through when the lever 50 is disposed between the temporary locking position and fitting completion stop position and the locking piece 26 is aligned with the shape of the pivot hole 55. The locking piece 26 inserted into the pivot hole 55 prevents the side plate 51 from coming off, when the locking piece 26 is in a range corresponding to a locking recess portion 57 that is formed in the outer surface of the side plate 51.

Figure 5A:
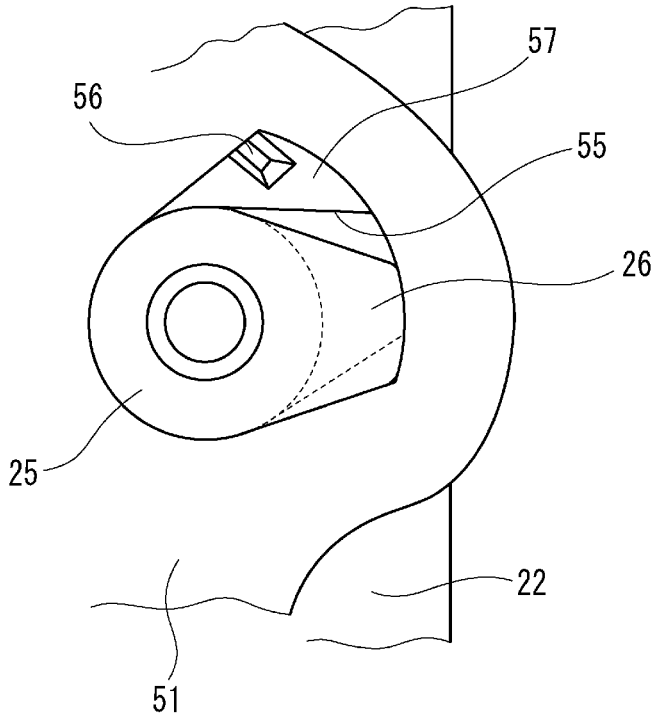
FIG. 5A is a side view showing a state in which the lever is disposed at the temporary locking position.
Figure 5B:
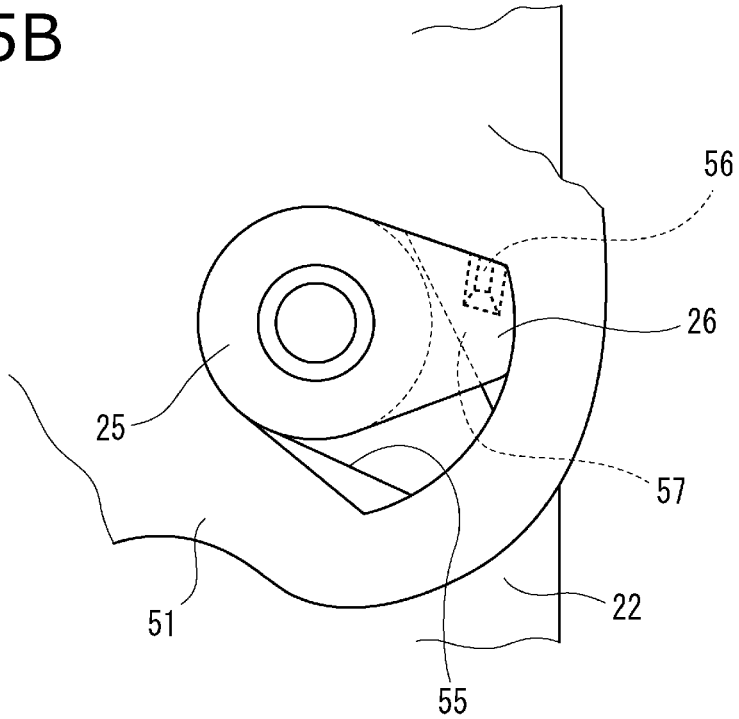
FIG. 5B is a side view in a state in which the lever is in the final locking position.

Further, as shown in FIGS. 5A and 5B, on the bottom surface of the locking recess 57, a pressed protrusion 56 is formed. The side plate 51 is moved toward the side surface 22 by the pressed protrusion 56 that is pressed by the inner surface of the locking piece 26 when the lever 50 is moved to the fitting completion position.

As shown in FIGS. 5A and 5B, when the lever 50 is disposed at the temporary locking position, the locking piece 26 of the support shaft 25 overlaps a part of the locking recess portion 57. As a result, in a state in which the side plate 51 of the lever 50 is disposed at the temporary locking position, the locking recess portion 57 is locked to the locking piece 26. Also, as shown in FIG. 5B, even when the lever 50 is disposed at the fitting completion position, the locking piece 26 of the support shaft 25 overlaps a part of the locking recess portion 57. As a result, even in a state where the side plate 51 of the lever 50 is disposed at the fitting completion position, the locking recess portion 57 is locked to the locking piece 26.

As shown in FIG. 4A, guide grooves 47 are formed on both sides 22 of the housing 20 and open up toward the front part 20*a*. The guide grooves 47 are formed along the front-rear direction of the housing 20. When the housing 20 is fitted to the mating housing 2, the cam bosses 5 and the guide protrusions 6 (see FIGS. 1 and 2) on both side surfaces of the mating housing 2 are inserted in the guide grooves 47.

As shown in FIG. 4B, a cam groove 77 is formed on an inner surface of each of the side plates 51 of the lever 50 facing the corresponding side surface 22 of the housing 20. The cam groove 77 is open on the front side of the lever 50 in a state of being moved to the temporary locking position and extends obliquely downward toward the rear side of the side plate 51. When the housing 20 is fitted to the mating housing 2, the cam bosses 5 of the mating housing 2 enters the cam grooves 77 respectively (see FIG. 6B). Then, when the lever 50 is rotated from this state toward the fitting completion position, the cam grooves 77 of the lever 50 rotate and the cam bosses 5 that has entered the cam grooves 77 are drawn toward ends of the cam grooves 77 (see FIGS. 7A and 7B). As a result, the housing 20 and the mating housing 2 are drawn to each other and fitted together.

On the inner surface of the side plate 51 of the lever 50, a locking protrusion 73 is formed for locking the lever 50 to the temporary locking position with respect to the housing 20. When the lever 50 is moved to the temporary locking position, the locking protrusion 73 is disposed in the guide groove 47 and is locked to the upper-edge portion of the guide groove 47 (see FIG. 6A).

On both sides 22 of the housing 20, there are escape grooves 43 in which the locking protrusions 73 are in a non-contact state when the lever 50 rotates. The escape groove 43 is formed in an arc shape with the support shaft 25 as its center.

Therefore, when the lever 50 is rotated toward the fitting completion position, the locking protrusion 73 goes over the upper-edge portion of the guide groove 47, is guided into the escape groove 43, and moves through the escape groove 43. When the lever 50 is rotated, the locking protrusion 73, formed on the inner surface of the side plate 51 of the lever 50, moves through the escape groove 43 formed on the side surface 22 of the housing 20. In this way, the lever 50 smoothly rotates in a predetermined direction without the locking protrusion 73 coming into contact with the side surface 22 of the housing 20.

A locking protrusion 73 and an escape groove 43 do not need to be provided on both side plates 51 and both sides 22; they may be provided only on one of the side plates 51 and sides 22.

As shown in FIGS. 3A and 3B, the housing 20 has a lever disengagement prevention part 35. The lever disengagement prevention portion 35 is provided at the upper position on both sides of the housing 20, and is formed so as to extend rearward along both sides 22 from the front portion 20*a*. The lever 50 has an upper-edge portion 61 and a vibration-suppressing protrusion 62 on a part of the side plate 51.

Figure 6A:
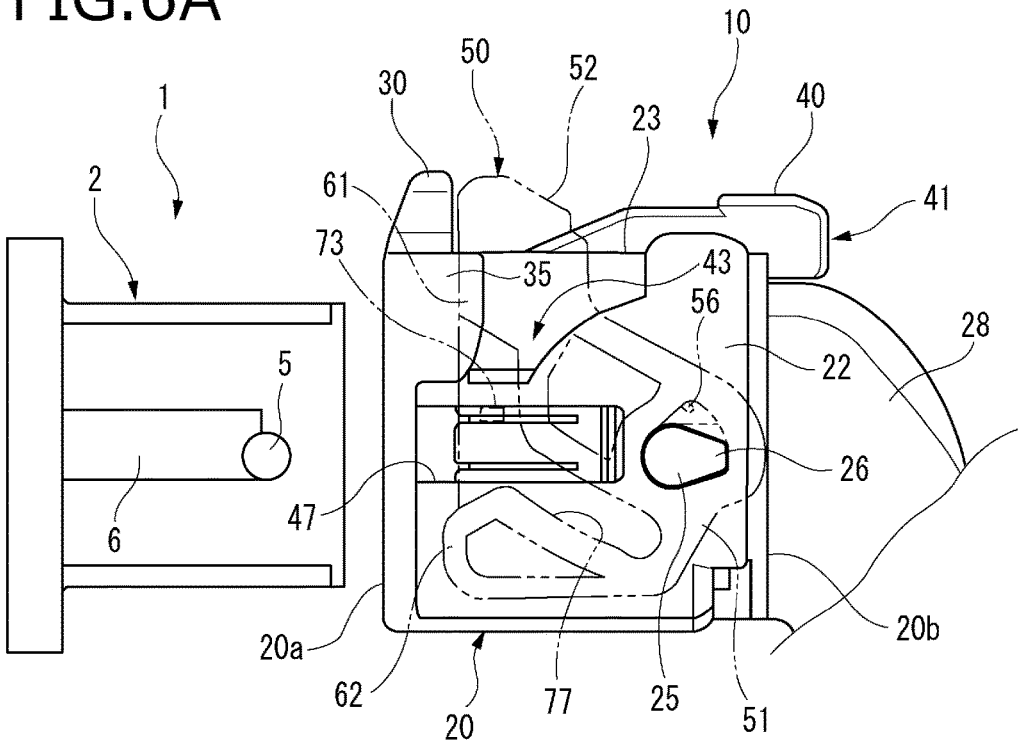

In a state where the lever 50 is moved to the temporary locking position, the upper-edge portion 61 of the side plate 51 facing the lever-disengagement prevention portion 35 goes inside the lever-disengagement prevention portion 35 (see FIG. 6A). By way of the lever 50 moving to the temporary locking position, the upper-edge portion 61 is covered from the outside by the lever-disengagement prevention portion 35, and the side plate 51 is prevented from being detached from the housing 20.

Figure 6B:
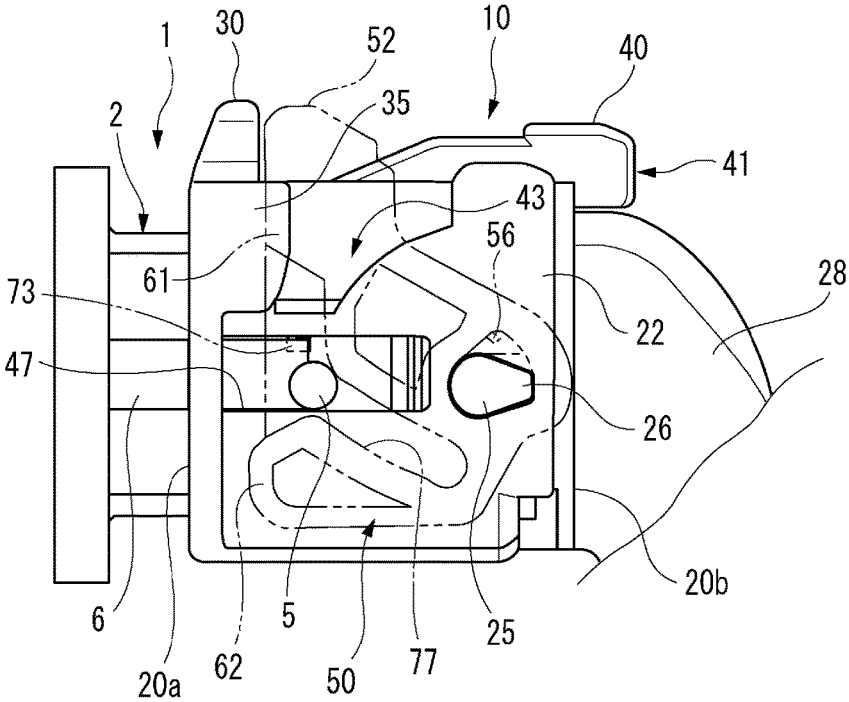

Further, in a state where the lever 50 is moved to the fitting completion position, the vibration-suppressing protrusion 62 goes inside the lever disengagement prevention portion 35 (see FIG. 6B). When the lever 50 is moved to the fitting completion position, the vibration-suppressing protrusion 62 of the side plate 51 is covered from the outside by the lever-disengagement prevention part 35 and the inner surface of the lever-disengagement prevention part 35 is pressed against the vibration-suppressing protrusion 62 thereby eliminating backlash of the side plate 51 with respect to the lever-disengagement prevention portion 35. It is sufficient if the inner surface of the lever disengagement prevention portion 35 is in contact with the vibration-suppression protrusion 62. An inner face of the lever-disengagement prevention portion 35 needs not be pressurized by the vibration-suppressing protrusion 62 as long as they are in a state in which there are no gaps.

Figure 8:
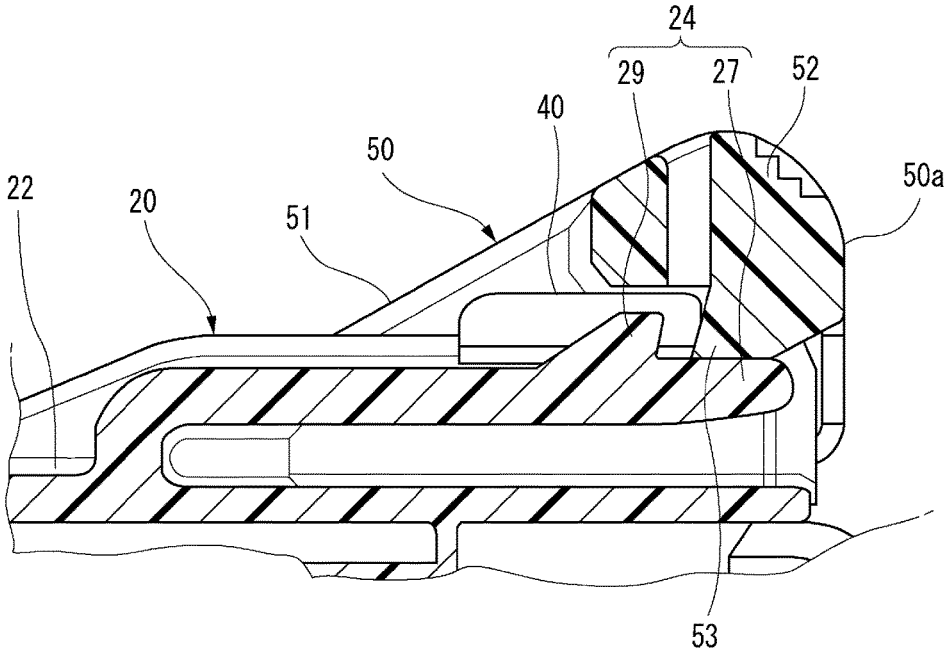
FIG. 8 is a cross-sectional view of an essential part for describing the engaging and locking of the operating portion by the lock portion.
Figure 9:
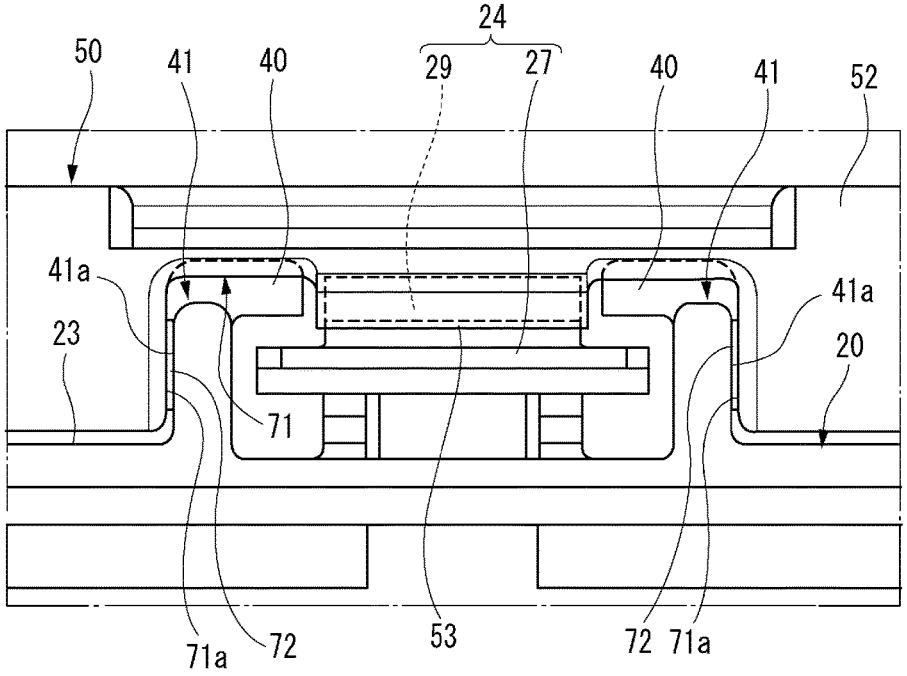
FIG. 9 is an enlarged view of the lock portion of the housing for locking the operating portion of the lever moved to the fitting completion position as viewed in the direction of arrow A in FIG. 3B.

As shown in FIGS. 1, 8 and 9, the lock portion 24 provided on the upper surface 23 of the housing 20 has a flexible arm portion 27 and an engaging portion 29. When the lever 50 is moved to the fitting completion position, the engaging portion 29 locks the lock portion 53 protruding from the operating portion 52.

As a result, the lock portion 53 of the lever 50 is locked to the engaging portion 29 of the lock portion 24 so that rotation of the lever 50 is restricted with respect to the housing 20, which is so called as a locked state.

A pair of walls 41 stand upright on the upper surface 23 of the housing 20 and are arranged on both sides of the lock portion 24 for locking the operating portion 52. Further, on the upper edge of each wall 41, an arm protection wall 40 extends inward so as to cover both sides of the flexible arm portion 27. Accordingly, since the lock portion 24 is surrounded by the pair of walls 41 and the arm protection wall 40, the flexible arm portion 27 is prevented from deformation due to being undesirably pressed on before fitting the connector.

Furthermore, as shown in FIG. 9, since the arm protection walls 40 are extended so as to cover and, thereby, overlap upper portions of both sides of the flexible arm portion 27, in the event that the flexible arm portion 27 is undesirably lifted up, deformation of the flexible arm portion 27 can be prevented by bringing the two sides in contact with the arm protection wall 40.

Furthermore, there are recessed portions 71 which can externally fit the pair of walls 41 in the operating portion 52 of the lever 50. When the lever 50 is moved to the fitting completion position, the inner surfaces 71*a* of the recessed portions 71 contact the opposing outer surfaces 41*a* of the pair of walls 41, respectively. That is, the recessed portions 71 of the operating portion 52 are externally fitted to the pair of walls 41 without gaps (a state of no gaps or pressurized contact). With backlash-eliminating protrusions 72 protruding inward provided on the inner surfaces 71*a* of the recessed portions 71 of the present embodiment, the backlash-eliminating protrusions 72 are compressed and deformed and the recessed portions 71 of the operating portion 52 are brought into pressurized contact with the pair of walls 41 (see FIGS. 1 and 9). As shown by the dashed line in FIG. 1, backlash-eliminating protrusions 42 protruding outward can also be provided on the outer surfaces 41*a* of the pair of walls facing the inner surfaces 71*a* of the recessed portions 71.

Therefore, the operating portion 52 of the lever 50 that is engaged and locked to the lock portion 24 in the fitting completion position is restrained from backlash against the upper surface 23 of the housing 20. As a result, even if an external force such as vibration or shock is applied to the lever, the operating portion 52 can be engaged and locked by the lock portion 24, thus high fitting reliability with the mating connector 1 can be achieved.

Next, a case where the lever-type connector 10 is fitted to the mating connector 1 will be described.

FIGS. 6 to 7 are views for describing the movement of the locking projection 73 and cam boss 5 in accordance with a rotation of the lever 50.

First, as shown in FIG. 6A, the housing 20 of the lever-type connector 10 in a state where the lever 50 is temporarily engaged in the temporary locking position is fitted to the mating housing 2 of the mating connector 1.

As shown in FIG. 6B, when the housing 20 is fitted to the mating housing 2 and the cam boss 5 and the guide protrusion 6 of the mating housing 2 are inserted into the guide grooves 47 of the housing 20, each of the cam bosses 5 abuts on respective one of the cam grooves 77 of the lever 50. When the housing 20 is further pushed into the mating housing 2, each of the cam bosses 5 of the mating housing 2 is pushed into the respective one of the cam grooves 77 of the lever 50, and the lever 50 is rotated toward the fitting start position by the pushing force. From this, each of the locking protrusions 73 of the side plates 51 of the lever 50 is released from engagement with respective one of the upper edge portions of the guide grooves 47 and enters corresponding one of the escape grooves 43.

Figure 7A:
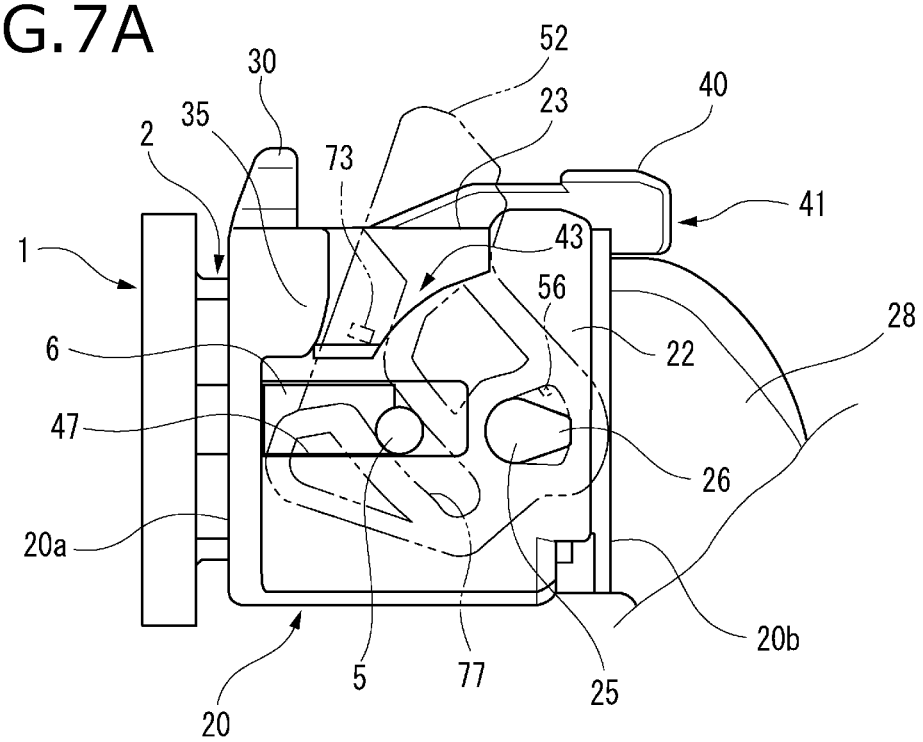

Then, as shown in FIG. 7A, the lever 50 temporarily engaged in the temporary locking position is pivoted toward the fitting start position so that the lever 50, which is disposed so as to overlap the lever-protection wall 30, separates from the lever-protection wall 30. Because of this, it is possible to easily hold the operating portion 52 of the lever 50 by the operator.

Figure 7B:
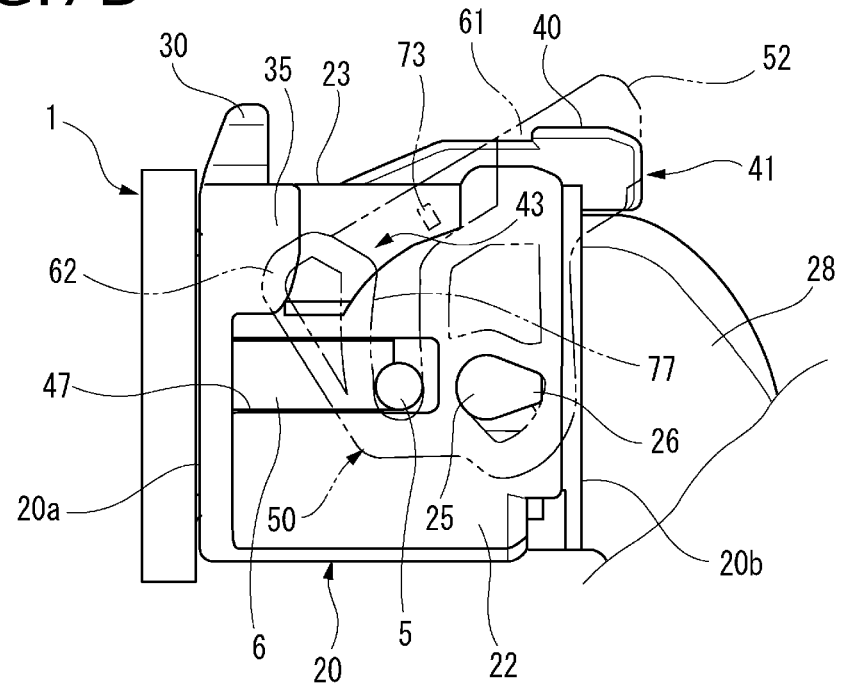

In this state, the operating portion 52 of the lever 50 is held and the lever 50 is rotated to the fitting completion position by the operator. Consequently, the cam bosses 5 of the mating housing 2 are retracted in the cam grooves 77 of the lever 50, and as shown in FIG. 7B, the housing 20 and the mating housing 2 are fitted to each other, the lever-type connector 10 is fitted to the mating connector 1, and the terminals are electrically connected.

When the lever 50 is moved to the fitting completion position, the lock portion 53 of the operation portion 52 is engaged and locked to the engaging portion 29 of the lock portion 24, and the rotation of the lever 50 relative to the housing 20 is restricted in the locked state. In addition, in the lock portion 24, the outer surfaces 41*a* of the pair of walls 41 compress and deform the backlash-eliminating protrusions 72 protruding from the outer surfaces 71*a* of the recessed portions 71 so as to be externally fitted without gaps (see FIG. 9). From this, the lever 50 suppresses backlash of the operating portion 52 that is engaged and locked to the lock portion 24 in the fitting completion position.

When the lever 50 is moved to the fitting completion position, the vibration-suppressing protrusion 62 of the side plate 51 enters the inside of the lever-disengagement prevention portion 35. Consequently, the vibration-suppressing protrusion 62 of the side plate 51 is covered from the outside by the lever-disengagement prevention portion 35 and the inner surface of the lever disengagement prevention portion 35 is brought into pressurized contact with the vibration-suppressing protrusion 62 (see FIG. 3B). As a result, backlash of the side plate 51 with respect to the lever-disengagement prevention portion 35 of the lever 50 is suppressed.

When the lever 50 is rotated to the fitting completion position, the pressed protrusion 56 protruding from the outer surface of each of the side plates 51 is pressed toward the side surfaces 22 by the inner surfaces of the locking pieces 26 of the support shafts 25, and the backlash of the side plates 51 with respect to the support shafts 25 of the housing 20 is suppressed in the lever 50 (see FIGS. 5A and 5B).

In this way, in the lever-type connector 10 of the present embodiment, the operating portion 52 of the lever 50 is held and the lever 50 is rotated by the operator, thereby the insertion force of the housing 20 applied to the mating housing 2 is assisted through the cam mechanism constituted by the cam groove 77 and cam boss 5.

As described above, according to the lever-type connector 10 according to the present embodiment, the lever-protection wall 30 formed on the housing 20 protrudes outward beyond the rotating outer peripheral end 50*a* of the lever 50 in the temporary locking position, and moreover, the operating portion 52 of the lever 50 disposed at the temporary locking position is disposed so as to overlap the lever-protection wall 30. Therefore, the lever 50 is prevented from being unintentionally rotated to a position deviating from the initial position during packing or transportation before fitting to the mating connector 1. Accordingly, it is possible to eliminate the troublesome work of returning the unintentionally rotated lever 50 to the temporary locking position, which is the initial position when fitting the lever 50 to the mating connector 1, and thereby smoothly perform the fitting operation with the mating connector 1.

Further, when the mating housing 2 and the housing 20 are fitted together, the cam boss 5 is pushed into the cam groove 77 and the lever in the temporary locking position moves toward the fitting start position so that the operating portion 52 of the lever 50, which was disposed so as to overlap with the lever-protection wall 30, separates from the lever-protection wall 30. From this, the operator can easily grasp the operation portion 52 of the lever 50 and smoothly rotate the lever 50 to the fitting completion position, thereby, making it easy to perform the fitting operation to the mating connector 1.

The present invention is not limited to the embodiment described above, and suitable modifications, improvements and so on can be made. Furthermore, the material, shape, dimensions, number, disposition, etc. of each component in the above embodiment is not limited as long as it can achieve the present invention.

Here, characteristics of the embodiment of the lever-type connector according to the present invention described above will be briefly summarized below in [1] and [2].

[1] A lever-type connector (10) including:
- a housing (20) configured to be inserted and removed from a mating housing (2) of a mating connector (1);
- a lever (50), pivotally mounted on the housing, and that is pivotally operable between a temporary locking position and a fitting completion position of the lever, the lever including:
  - a pair of side plates (51) arranged along surfaces on both sides (22) of the housing; and
  - an operating portion (52) that connect ends of the side plates,
- wherein the housing is configured to be fitted to the mating housing (2) by a rotating operation of the lever from a fitting start position to the fitting completion position;
- wherein the housing has a lever-protection wall (30) protruding outward beyond a pivotal outer peripheral end (50*a*) of the lever that is disposed at the temporary locking position, the lever-protection wall being provided at an end portion of the housing in a direction opposite to a rotational direction in which the lever rotates from the temporary locking position toward the fitting completion position; and
- wherein the lever disposed at the temporary locking position is arranged so that the operating portion (52) of the lever overlaps the lever-protection wall.

[2] The lever-type connector (10) according to [1], wherein cam grooves (77) are provided in the side plates (51) of the lever respectively and are configured to pull cam bosses (5) formed on both outer surfaces of the mating housing (2) thereinto in accordance with a rotation of the lever from the temporary locking position to the fitting completion position; and wherein when the mating housing and the housing (20) are fitted together, the cam bosses are pushed into the cam grooves respectively, and the lever is rotated toward the fitting start position in a state that the cam bosses are entered into the cam grooves respectively.

What is claimed is:

1. A lever-type connector comprising:

a housing configured to be inserted and removed from a mating housing of a mating connector; and a lever, pivotally mounted on the housing, and that is pivotally operable between a temporary locking position and a fitting completion position of the lever, the lever comprising:

a pair of side plates arranged along surfaces on both sides of the housing; and an operating portion that connect ends of the side plates, wherein the housing is configured to be fitted to the mating housing by rotating the lever from a fitting start position to the fitting completion position;

wherein the housing has a lever-protection wall, protruding outward beyond a pivotal outer peripheral end of the lever disposed at the temporary locking position, the lever-protection wall being provided at an end portion of the housing in a direction opposite to a rotational direction in which the lever rotates from the temporary locking position toward the fitting completion position; and wherein the lever disposed at the temporary locking position is arranged so that the operating portion of the lever overlaps the lever-protection wall.

2. The lever-type connector according to claim 1, wherein cam grooves are provided in the side plates of the lever respectively and are configured to pull cam bosses formed on both outer surfaces of the mating housing thereinto in accordance with a rotation of the lever from the temporary locking position to the fitting completion position; and wherein when the mating housing and the housing are fitted together, the cam bosses are pushed into the cam grooves respectively, and the lever is rotated toward the fitting start position in a state that the cam bosses are entered into the cam grooves respectively.

3. The lever-type connector according to claim 1, wherein the temporary locking position is a position of the lever in which the housing is configured to be initially inserted into the mating housing to fit the housing to the mating housing.

* * * * *